United States Patent [19]

Scobie et al.

[11] Patent Number: 5,007,330

[45] Date of Patent: Apr. 16, 1991

[54] ROTARY ACTUATOR AND SEAL ASSEMBLY FOR USE THEREIN

[75] Inventors: William B. Scobie, Houston; Robert A. Frenzel, Waller, both of Tex.

[73] Assignee: Keystone International Holdings Corp., Houston, Tex.

[21] Appl. No.: 452,207

[22] Filed: Dec. 18, 1989

[51] Int. Cl.[5] ..... F01C 9/00

[52] U.S. Cl. ..... 92/120; 92/137; 92/130 R; 92/130 C; 92/177; 277/217; 277/138; 277/174; 277/176; 277/177; 277/207 R

[58] Field of Search ..... 92/120, 138, 137, 132, 92/165 R, 130 R, 177, 233, 130 C; 277/138, 207 R, 217, 173, 174, 175, 176

[56] References Cited

U.S. PATENT DOCUMENTS

| | | | |
|---|---|---|---|
| 2,649,077 | 8/1853 | Nehm | 92/120 |
| 3,051,143 | 8/1962 | Nee | 92/98 R |
| 3,394,941 | 7/1968 | Traub | 277/176 |
| 3,444,788 | 5/1969 | Sneen | 92/177 |
| 3,446,120 | 5/1969 | Sneen | 92/177 |
| 4,379,543 | 4/1983 | Reaves | 92/130 C |
| 4,480,811 | 11/1984 | Card et al. | 92/137 |
| 4,628,797 | 12/1986 | Kendall | 92/120 |
| 4,917,390 | 4/1990 | Lee e tal. | 277/176 |
| 4,930,791 | 6/1990 | Ungchusri et al. | 277/207 R |

FOREIGN PATENT DOCUMENTS

| | | | |
|---|---|---|---|
| 503122 | 7/1949 | Canada | 92/120 |
| 2553433 | 10/1972 | Fed. Rep. of Germany . | |
| 2925779 | 1/1980 | Fed. Rep. of Germany | 277/217 |
| 0163805 | 9/1983 | Japan | 92/120 |
| 245146 | 10/1946 | Switzerland | 92/120 |
| 327065 | 2/1958 | Switzerland | 277/174 |
| 1363609 | 8/1874 | United Kingdom . | |

OTHER PUBLICATIONS

"Zero-Gradient Spring System", Sanford W. Groesberg, *Machine Design*, Jan. 21, 1960, pp. 143-147.

*Primary Examiner*—John T. Kwon
*Assistant Examiner*—Thomas Denion
*Attorney, Agent, or Firm*—Browning, Bushman, Anderson & Brookhart

[57] ABSTRACT

A rotary actuator comprising a housing which defines an arcuate chamber, the housing including a first monolithic portion in which the arcuate chamber is completely contained, a piston disposed in the housing for reciprocable movement in the arcuate chamber, a shaft journaled in the housing and connected to the piston and being rotated in response to movement of the piston, a floating seal assembly carried by one of the piston or the housing for effecting sealing between the piston and the housing, a fluid pressure port to introduce fluid into the housing to effect movement of the piston in the first direction and a means such as fluid pressure or a spring return to effect movement of the piston in an opposite second direction, the actuator in one preferred embodiment employing a spring return which provides a substantially constant torque acting upon the shaft as the spring moves from a compressed first position to an uncompressed second position such that the torque acting upon the shaft in both rotational directions is substantially constant.

23 Claims, 3 Drawing Sheets

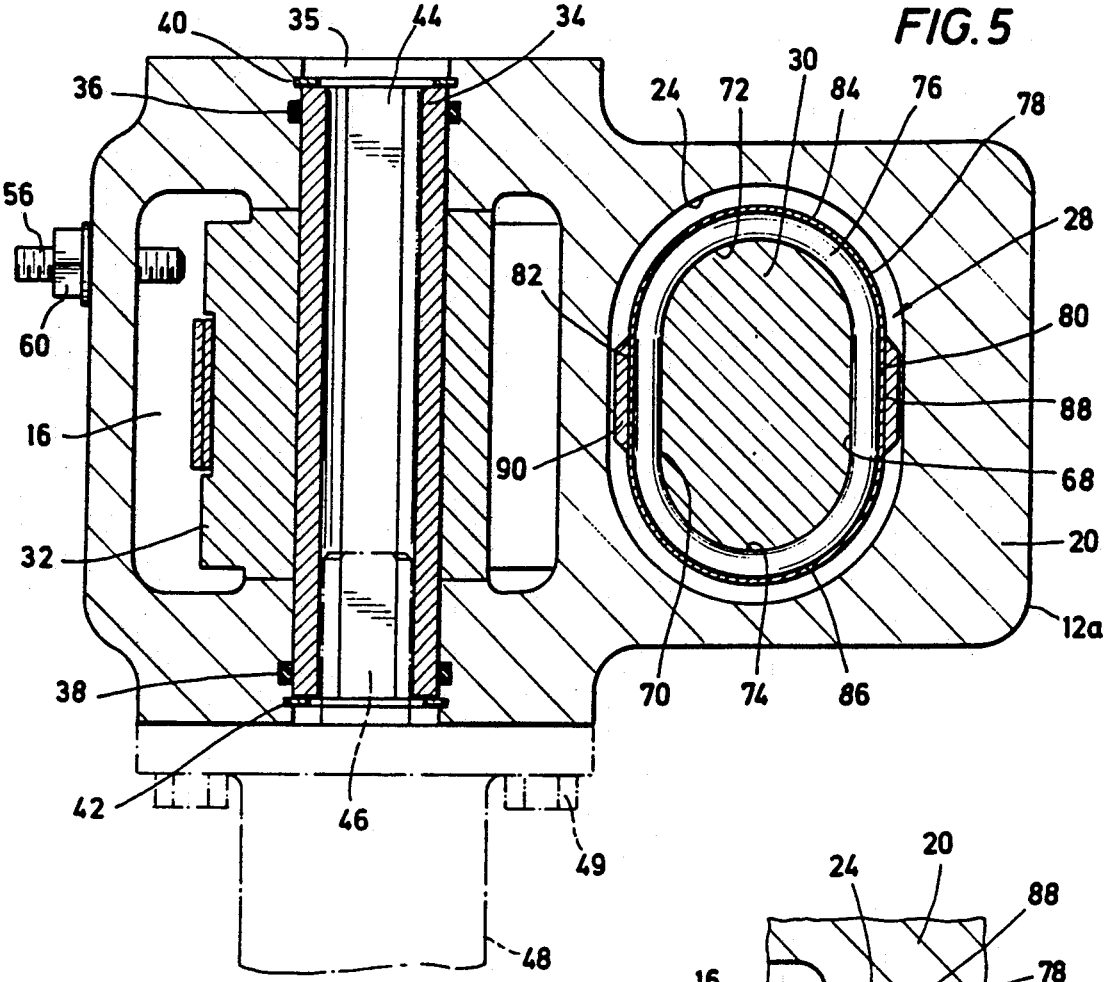
FIG. 5
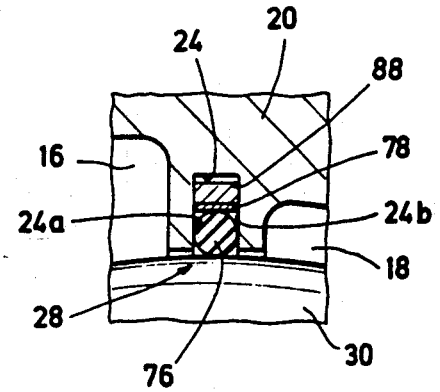
FIG. 7
FIG. 6
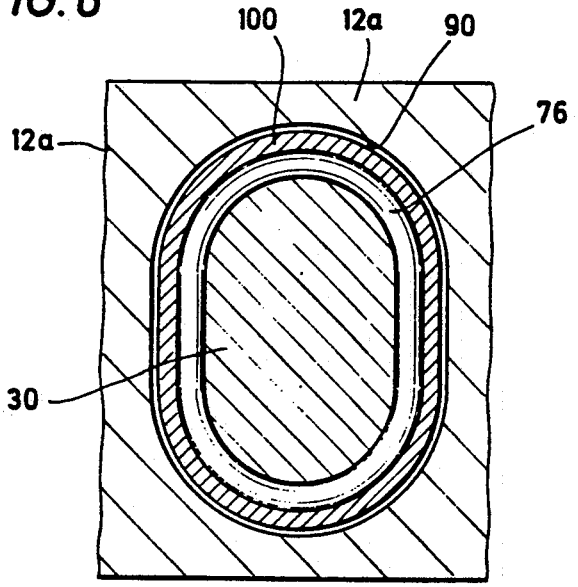
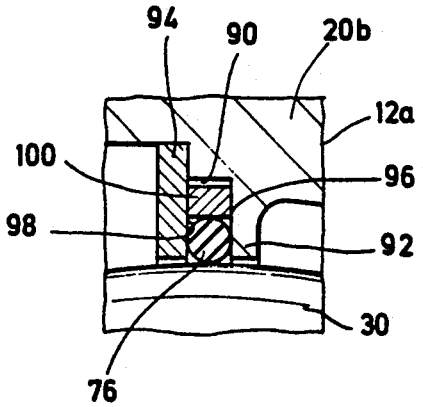
FIG. 8

ROTARY ACTUATOR AND SEAL ASSEMBLY FOR USE THEREIN

BACKGROUND OF THE INVENTION

1. Field of the Invention

The present invention relates to actuators. More particularly, the present invention relates to rotary actuators of the type which produce rotary motion of a shaft by means of a piston oscillating in a generally arcuate chamber.

2. Description of the Background

Rotary actuators are used in a variety of applications where it is desired to effect movement of a rotary fashion about a center point. For example, such actuators can be used to open and close valves, turn switches, operate steering mechanisms, etc. The actuator may be of the double-acting type wherein fluid, either hydraulic or pneumatic, is used to displace the piston in oscillating manner in an arcuate chamber to hence effect rotation of a shaft in a clockwise or counterclockwise direction depending upon movement of the attached piston. Alternatively, rotary actuators can be of the single-acting type wherein a fluid pressure is used to displace the cylinder and hence effect rotation of the shaft in one direction while rotation of the shaft in the other direction is accomplished by mechanical means such as a spring return automatically upon release of pressure acting on the piston.

A problem which has long plagued rotary actuators is sealing. Prior art rotary actuators are conventionally of a split body design in which the housing of the actuator is formed of two half sections, generally mirrors images of one another, which are adjoined such that a plane passing through the adjoined surfaces passes transversely, generally perpendicular, through the rotatable shaft journaled in the housing. In a double-acting actuator, it is necessary that the two halves of the housing be in fluid-tight sealing if the actuator is to operate efficiently. Further, in such double-acting actuators or for that matter even single-acting actuators, it is necessary that a seal be formed between the oscillating or reciprocating piston and the interior of the housing so that a fluid-tight chamber can be formed in which fluid pressure can be introduced to act on the piston and effect rotation of the shaft. The seal between the piston and the housing invariably lies in a plane which is generally perpendicular to the seal between the two mirror image halves of the housing. Accordingly, in such rotary actuator designs there are two inter-connecting seals, i.e. the seal between the piston and the housing and the seal between the two housing halves which further complicates an already complicated sealing problem.

In rotary actuators of the single-acting type, and as noted above, fluid pressure is used to effect movement of the piston in one direction while a mechanical system such as a return spring operates to automatically move the piston in the other direction when pressure is released thus effecting clockwise and counterclockwise movement of the shaft to which the piston is attached. Particularly when such single-acting actuators are used in connection with valves, such as butterfly valves, it is desirable that the torque characteristics of the actuator be known to facilitate matching of the actuator to the particular valve style. In particular, it is desirable to have a single-acting actuator in which the opening and closing torque exerted by the actuator and hence on the valve is substantially constant such that in matching the actuator to a particular valve, it will be known that throughout the full travel, i.e. from open to close, of the valve, the actuator has a constant torque rating.

SUMMARY OF THE INVENTION

It is therefore an object of the present invention to provide an improved rotary actuator of the double-acting type.

Yet another object of the present invention is to provide an improved rotary actuator of the single-acting type.

Yet a further object of the present invention is to provide a rotary actuator which minimizes sealing complications brought on by the seal between actuator housing halves intersecting the seal between the actuator piston and the housing.

Still a further object of the present invention is to provide a rotary actuator in which the input and output torque are substantially constant.

Another object of the present invention is to provide a sealing apparatus between two relatively moveable members such as between the piston and housing of a rotary actuator.

The above and other objects of the present invention will become apparent from the drawings, the description given herein and the appended claims.

In one embodiment, the present invention provides a rotary actuator having a housing which defines an arcuate chamber. The housing includes a first monolithic portion, the arcuate chamber being completely contained within the first monolithic portion. A piston is disposed in the housing for reciprocable movement in the arcuate chamber. A shaft, journaled in the housing, is connected to the piston, the shaft being rotated in response to movement of the piston. A seal means, carried by one of the piston or the housing, effects sealing between the piston and the housing and, in the usual case, isolates the arcuate chamber from a second chamber formed in the housing. There are means to introduce fluid pressure into the arcuate chamber to effect movement of the piston in the first direction and means to effect movement of the piston in an opposite, second direction.

In another embodiment, the present invention provides a rotary actuator having a housing which defines an arcuate chamber and a piston disposed in the housing for reciprocable movement in the arcuate chamber. A shaft, journaled in the housing, is connected to the piston and is rotated in response to movement of the piston. A seal is carried by either the piston or the housing for effecting sealing between the piston and housing. There are means to introduce fluid pressure into the arcuate chamber to effect movement of the piston in a first direction out of the arcuate chamber and rotation of the shaft in a first rotational direction. There are also means to effect movement of the piston in an opposite, second direction into the arcuate chamber with rotation of the shaft in a second rotational direction, such means including a support which is positioned on the housing, the support carrying a compressible biasing member e.g., a spring. There are means which interconnect the biasing member and the shaft such that movement of the piston out of the arcuate chamber compresses the biasing member. The means interconnecting the biasing member of the shaft is operative to provide a substantially constant torque acting upon the shaft as the biasing member moves from a compressed first position to an uncompressed second position such that the torque acting on the shaft in the first and second rotational directions is substantially constant.

In yet another embodiment of the present invention, there is provided an apparatus for sealing between two relatively moveable members, the apparatus including a first member which has a surface defining a bore. A peripheral or circumferential groove is formed in the surface, the groove having peripherally extending, spaced first and second side walls, A second member is disposed in the bore and relatively movable with respect to the first member. The second member has a symmetrical cross-sectional configuration. The bore has a cross-sectional configuration which is complementary to the cross-sectional configuration of the second member. There is also a seal assembly which effects fluid-tight sealing between the first and second members which includes a resilient seal ring, the second member being received in and sealingly engaged by the seal ring. The seal assembly further includes a generally flexible taut band in surrounding, engaged relationship with the seal ring. The seal assembly is received in the groove such that the resilient seal ring is in the sealing engagement with the first and second side walls in the groove, the band serving to prevent outward bowing of the seal ring away from the second member. The groove has a depth sufficient to permit the seal assembly to float to compensate for manufacturing tolerances and/or distortion or flexing of the second member.

BRIEF DESCRIPTION OF THE DRAWINGS

FIG. 5 is an elevational view, partly in section and taken along the line 5—5 of FIG. 1.

FIG. 6 is a fragmentary view showing an alternative sealing assembly to that shown in FIG. 5.

FIG. 7 is an enlarged, fragmentary cross-sectional view of the seal assembly shown in FIG. 5.

FIG. 8 is an enlarged, fragmentary cross-sectional view of the seal assembly shown in FIG. 6.

BRIEF DESCRIPTION OF PREFERRED EMBODIMENTS

Figure 1:
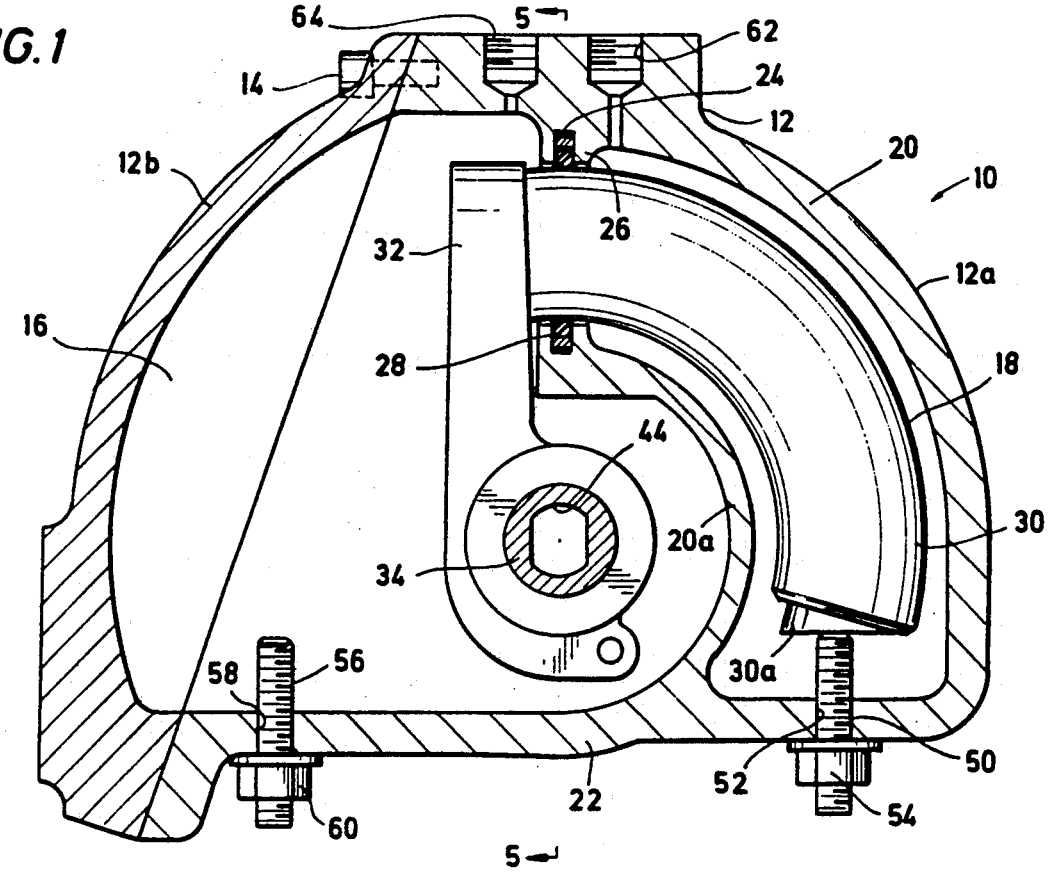
FIG. 1 is a top view, partly in section, of one embodiment of the actuator of the present invention showing the piston in a first position.
Figure 2:
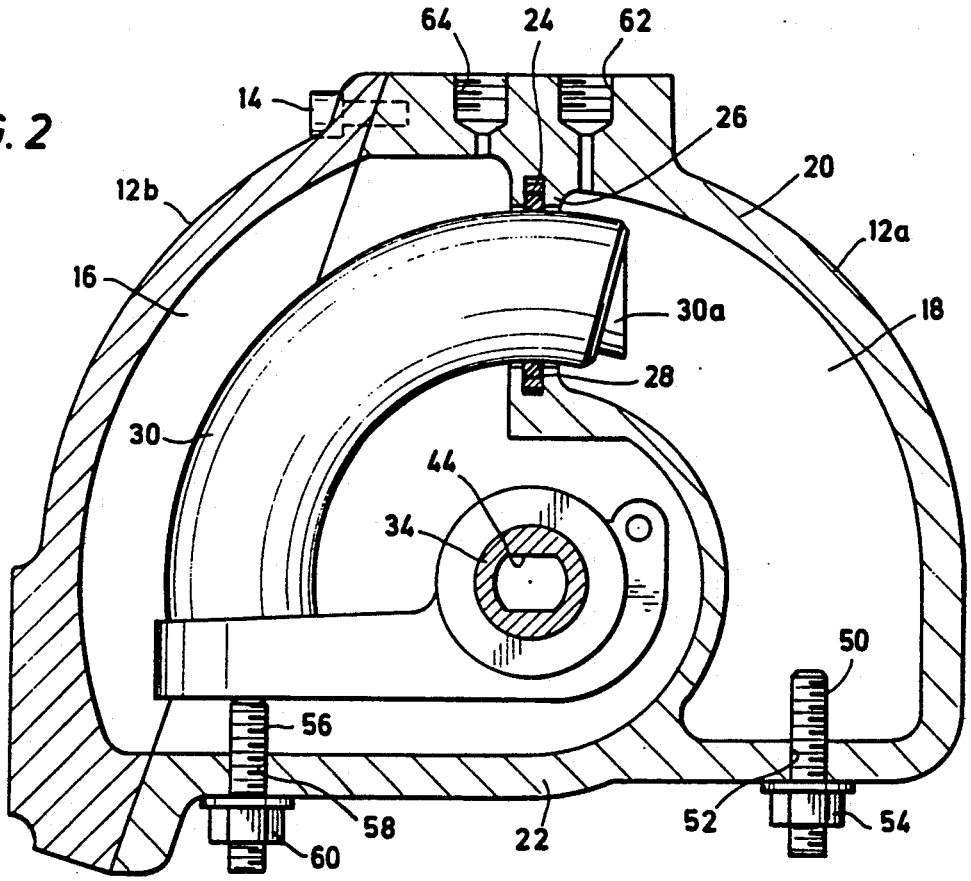
FIG. 2 is a view similar to FIG. 1 showing the piston in a second position.

Referring first to FIGS. 1, 2 and 5, the rotary actuator, shown generally as 10, includes a housing 12 formed of first and second sections 12A and 12B, respectively. As shwon, sections 12A and 12B are monolithic and are connected together by means of bolts such as bolt 14. Although not shown, suitable gasketing or other sealing can be provided between sections 12a and 12B. When assembled, sections 12A and 12B cooperate to form an internal chamber 16 while section 12A forms an arcuate chamber 18 which is completely contained within section 12A. As can be seen, chamber 18 is in the shape of a toroidal arc segment having a generally oval or elliptical cross-section formed by a wall 20 having an inwardly extending wing portion 20A, walls 20, 20A combining with an end wall 22 to form arcuate chamber 18.

A peripheral or circumferential groove 24 is formed in a peripheral or circumferential, radially inwardly extending rib 26 of wall 20, 20A, a seal assembly shown generally as 28 being disposed in groove 24. The seal assembly 28, described more fully hereafter, effectively isolates chamber 18 from chamber 16 and is in sealing engagement with housing 12 and a piston 30 disposed in chamber 18.

Piston 30 is connected, and generally, though not necessarily, monolithically formed with, a link member or arm 32 which is rigidly affixed, e.g. by keying, to a shaft 34 journaled in housing 12 whereby movement of piston 30 is transferred via arm 32 to shaft 34 to effect rotation of shaft 34 about its axis. As best seen with reference to FIG. 5, shaft 34 is generally hollow and is journaled in a throughbore 35 in housing 12, sealing being accomplished by means of O-rings 36 and 38, shaft 34 being retained in housing 12 by means of snap rings 40 and 42. As shown, shaft 34 is provided with a central bore 44 which is of double-D configuration whereby shaft 34 can be attached to a driven member such as a valve stem shown in phantom as 46, stem 46 protruding from the neck 48 (shown in phantom) of a valve such as a butterfly valve secured to actuator 10 by means of bolts (shown in phantom as 49). Accordingly, rotation of shaft 34 will result in rotation of driven shaft 46. Piston 30 is provided with a projecting nose portion 30A. Extending into arcuate chamber 18 is an adjustable stop 50, stop 50 being threadedly received in a threaded bore 52 in end wall 22 and having a lock nut 54 to maintain stop 52 at a predetermined location. Stop 50 cooperating with nose portion 30A of piston 30 serves to limit movement of piston 30 into arcuate chamber 18. There is also provided a second stop 56 which is likewise threadedly received in a threaded bore 58 in wall 22 and is provided with a lock nut 60 to set stop 56 at a predetermined location. As best seen with reference to FIG. 2, stop 56 serves to limit movement of piston 30 in chamber 16, such limited movement being accomplished by abutment of arm 32 with stop 56 when piston 30 has rotated 90° from the position shown in FIG. 1.

The actuator shown in FIGS. 1 and 2 is of double-acting type and, accordingly, is provided with means to effect oscillating movement of piston 30 in both the clockwise and counter-clockwise direction by means of fluid pressure. To this end, housing 12 is provided with a first fluid inlet port 62 which is in open communication with arcuate chamber 18 and which provides a means to introduce a hydraulic or pneumatic fluid into arcuate chamber 18 whereby piston 30 will be forced out of chamber 18 and into chamber 16. Housing 12 also has a second fluid inlet port 64 which is in open communication with chamber 16 by which a pneumatic or hydraulic fluid can be introduced into chamber 16 to act upon piston arm 32 and piston 30 and effect movement of piston 30 out of chamber 16 into chamber 18. Accordingly, oscillating or reciprocating movement of piston 30 can be effected with a corresponding clockwise and counter-clockwise, 90° rotation of shaft 34.

The unique design of the actuator shown in FIGS. 1 and 2 eliminates problems encountered when trying to effect sealing between two intersecting, peripherally or circumferentially extending seals. Since arcuate chamber 18 is wholly contained within housing section 12A, seal assembly 28 does not intersect any seal between body section 12A and body section 12B. Insertion of the piston arm assembly 30, 32 presents no problems since arm 32 carrying piston 30 can be positioned in the housing 12 followed by insertion of shaft 34 in through bore 35 in housing section 12A.

Referring now to FIGS. 5–8, the seal assemblies of the present invention are shown. As can be seen, while the cross-sectional configuration of piston 30 is shown as being generally elliptical or oval, it will be appreciated that it can be circular or have numerous other configurations which are symmetrical and generally radiused. More specifically, with particular reference to FIG. 5, it can be seen that the symmetrical cross-section of piston 30 is defined by first and second side surfaces 68 and 70, respectively, side surfaces 68 and 70 having spaced, parallel side portions, side surfaces 68 and 70 being adjoined to end surfaces 72 and 74, the greatest distance between side surfaces 68 and 70 being less than the greatest distance between end surfaces 72 and 74. As can be seen, while the cross-section of piston 30 is generally elliptical, it varies from a true ellipse by virtue of the fact that side surfaces 68 and 70 are substantially straight and parallel to one another.

Seal assembly 28 comprises a resilient seal ring 76 which is received around piston 30 and is in sealing engagement therewith. Generally speaking, seal ring 76 can be made as a conventional o-ring and stretched to accommodate the profile of piston 30. Surrouding and engaged with seal ring 76 is a relatively thin, taut flexible band 78, band 78 being tightly engaged against seal ring 76. Flexible band 78, preferably made of steel or some other metallic material, has spaced first and second side portions 80 and 82 adjoined by first and second end portions 84 and 86, respectively, with the greatest distance between the side portions being less than the greatest distance between the end portions. Thus, band 78 defines a generally elliptical configuration which is complementary to the cross-sectional configuration of piston 30. Band 78 is flexible, not in the sense that it can be stretched or elongated along its length or periphery, but rather in the sense that it has sufficient flexibility to be placed in surrouding, engaged relationship around the complete periphery of seal ring 76. Rigid rib members 88 and 90 are secured, as by welding, to side portions 80 and 82, respectively, rib members 88 and 90 serving to stiffen side portions 80 and 82 and prevent outward bowing of side portions 80 and 82 away from piston 30 and hence loss of sealing engagement between piston 30 and seal ring 76. It will be appreciated that when the cross section of the piston is circular, the reinforcing ribs e.g. rib members 88 and 90, can be dispensed with, the taut band serving in and of itself to maintain the seal ring in engagement with the piston.

It is well known that in rotary actuators of the type under consideration, under any substantial pressure, the generally arcuate piston will undergo flexing. The direction of force exerted on the piston by fluid pressure, as for example piston 30 in chamber 18, is normally against the piston face and perpendicular to the axis of the piston arm i.e. arm 32. The floating seal design 28 of the present invention provides a simple and effective means to accommodate piston flexing and manufacturing tolerances and still ensure sealing between piston 30 and housing 12. To this end, groove 24 which is formed by side walls 24A and 24B has a depth which allows piston assembly 28 to float thus ensuring that seal ring 76 remains in sealing engagement with piston 30. In this regard it should be observed that when seal assembly 28 is received in groove 24, seal ring 76 is in sealing engagement with side walls 24A and 24B of groove 24. Hence, seal ring 76 is in effective, fluid-tight sealing engagement with piston 30 and housing 12.

FIG. 6 shows a modified seal assembly wherein a groove 90 is formed by a peripherally or circumferentially extending rib 92 of wall 20B of housing section 12A and an elliptical ring-like retainer plate 94 secured to wall section 20B by screws or the like (not shown). Groove 90 is defined by side walls 96 and 98 formed by rib 92 and plate 94, respectively. Resilient seal ring 76 is received in a rigid backup ring 100 which ensures constant and uniform engagement of seal ring 76 with piston 30. As best seen with reference to FIG. 6, seal ring 76 is completely surrounded and engaged by rigid backup ring 100. As in the case of the seal assembly shown in FIG. 7, when the seal assembly of FIG. 6 is received in the groove 90, there is sealing engagement of seal ring 76 with piston 30 and side walls 96 and 98 of groove 90. Additionally, groove 90, like groove 24 has a depth around its periphery efficient to permit the seal assembly to float in groove 90 and thereby accommodate any flexing of piston 30 which may occur.

Although the piston 30 can have any symmetrical, cross-sectional configuration such as round, oval, etc., it is especially preferred to employ the generally elliptical configuration shown. The use of a generally elliptical cross-section results in greater piston area than could be achieved with a piston having a circular cross-section and thereby results in a corresponding increase in torque. At the same time, the overall diameter and "footprint" of the actuator is not increased. More over, the elliptical or oval design is clearly preferable to a rectangular design because of the difficulty in attempting to effect a fluid-tight seal between a piston having such a cross-section and the housing.

Figure 3:
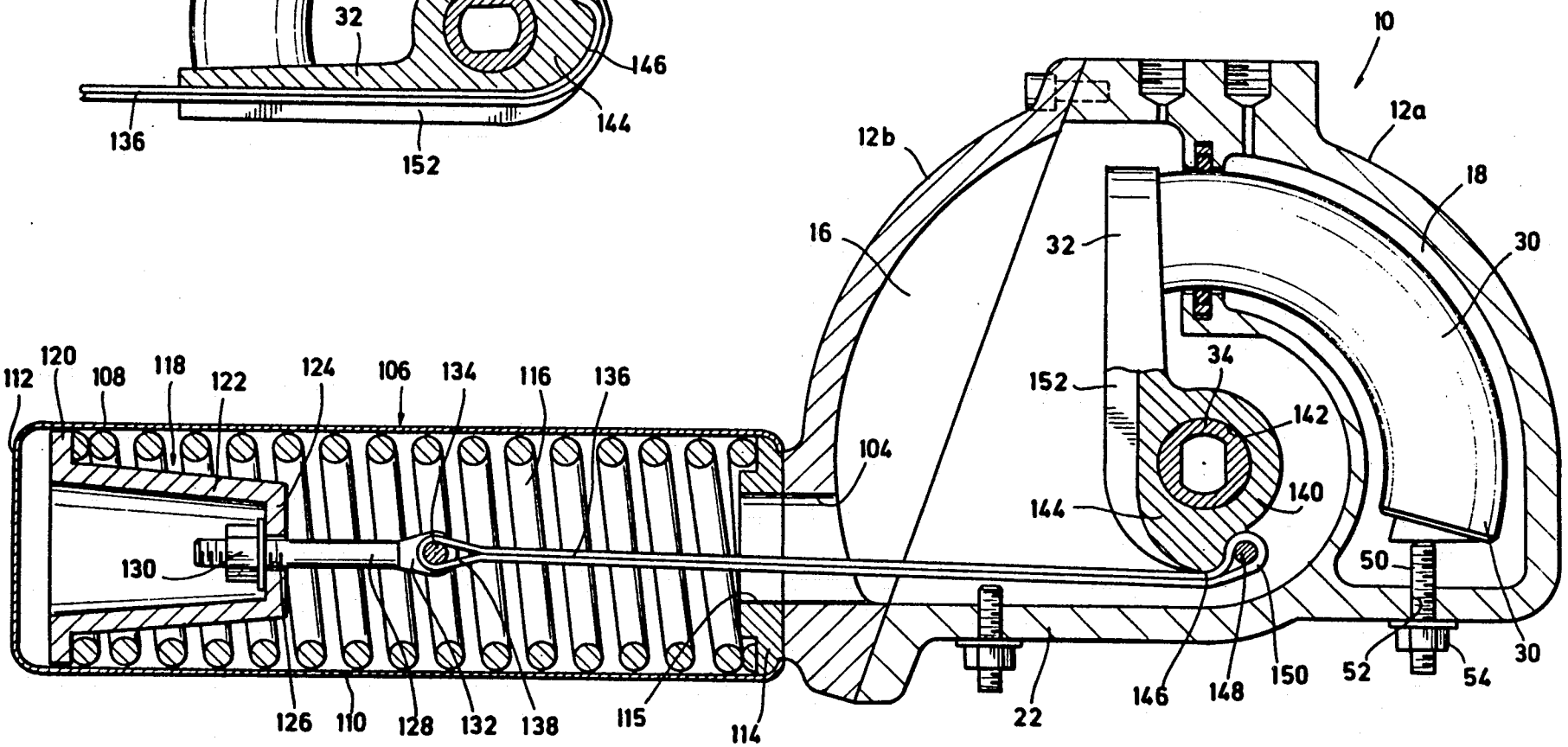
FIG. 3 is a view to FIG. 1 and showing a single-acting actuator having a spring return.
Figure 4:
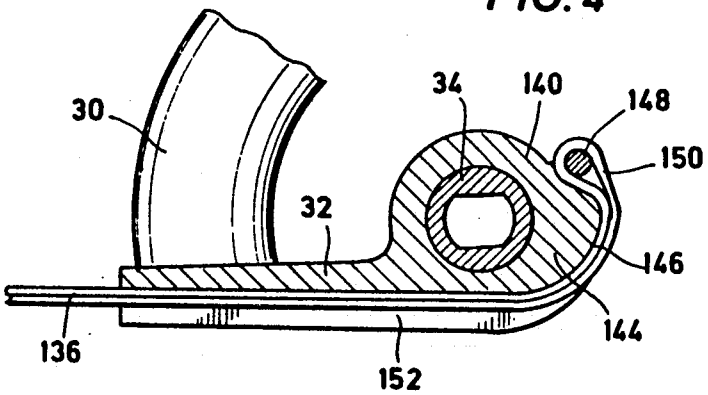
FIG. 4 is a fragmentary view showing the cam moved 90° from the position shown in FIG. 3.

Referring now to FIGS. 3 and 4, there is shown an embodiment of the actuator of the present invention equipped with a spring return. The construction of actuator 10 as shown in FIGS. 3 and 4 is identical to that shown in FIGS. 1 and 2 with the exception that housing section 12B is provided with a hole 104 extending therethrough. A spring canister 106 is positioned next to housing section 12B, spring canister 106 comprising a cylindrical can portion 108 having a cylindrical side wall 110 and a first end wall 112 generally monolithically formed with side wall 110. Spring canister 106 also includes an end cap 114, cylindrical wall 110 being affixed to end cap 114 by roll crimping. Although not shown, canister 106 can be affixed to housing section 12B by means of bolts or some other suitable means. Disposed internally of canister 106 is a coil compression spring 116, one end of coil spring 116 engaging end cap 114. In effect, canister 106 serves as a support for spring 116. A spring guide 118 includes an annular flange portion 120 which engages the other end of the spring 116. Spring guide 118 includes a frusto-conical guide portion 122 having an end wall 124 with a generally centrally disposed bore 126. A strap bolt 128 has a threaded end received through bore 126, the threaded end of strap bolt 128 being threadedly engaged by a nut 130. Strap bolt 128 includes an enlarged head portion 132 provided with a strap pin 134 which extends transversely through strap bolt 128. A flexible strap 136 having a looped end 138 is secured to strap bolt 128 by virtue of strap pin 134 being received in the looped end 138 of strap 136. Flexible strap 136 extends through aperture 115 in end cap 114 and registering hole 104 in housing section 12B.

Arm 32, which is noted above as generally monolithically formed with piston 30, includes a boss 140 having a bore 142 which receives shaft 34. Boss 140 forms a cam 144 defining a cam surface 146. A cam pin 148 is affixed to boss 140 and engages a second looped end 150 of strap 136. Tension on strap 136 between cam pin 150 and strap pin 134 is adjusted by means of nut 130 such that strap 136 stays in contact with cam surface 146 as arm 32 rotates around the axis of shaft 34. Arm 32 is also provided with a guide slot 152 in which strap 136 rides as arm 32 rotates. In the embodiment shown in FIG. 3, spring 116 is in its generally relaxed or uncompressed state. As pressure is introduced into chamber 18, piston 30 will be caused to move out of chamber 18 into chamber 16 which will result in rotation of shaft 34 and a winding of strap 136 around cam surface 146. Movement of piston 18 will continue until shaft 34 has rotated 90° to the position shown in FIG. 4 at which point strap 136 will be generally aligned along the length of arm 32 in slot 152 at which point spring 116 will be in a compressed state (not shown).

It can be seen from a comparison of FIGS. 3 and 4 that the interaction of cam surface 146 and strap 136 provides a variable moment arm about a fixed point determined by the axis of shaft 134, the moment arm being a maximum in the position shown in FIG. 3 and a minimum shown in FIG. 4. BY properly selecting the spring as to force and the cam profile or cam surface 146, the torque exerted by the spring 116 on shaft 34 can be kept constant throughout the range of rotational movement of shaft 134. Design of such a spring-cam combination can be achieved by methods well known to those in the art, see Groesberg, Sanford W., "O-Gradient Spring System", *Machine Design*, Jan. 21, 1960, p. 143, incorporated herein by reference.

To design an actuator which exhibits constant torque during both clockwise and counterclockwise rotation of shaft 34, the spring and cam surface are designed so as to provide an output torque equal to half that of the piston-piston arm combination alone. Accordingly, and with a predetermined pressure applied to chamber 18 and assuming that in FIG. 3 the actuator is affixed to a valve in the closed position, torque generated upon opening the valve will be constant and equal to the torque exerted by the spring return which will also be constant during closing of the valve.

The flexible member, i.e. strap 136, need only be strong enough to withstand the maximum force of spring 116 and yet flexible enough to follow can surface 146 faithfully. In this regard, it should be noted that cam surface 146 must be continuous without any reversals in curvature, i.e. no concavities or the like in the surface. Strap 136 can be conveniently constructed from chain, metal band, rope, cable, etc.

It will be recognized that the unique seal assembly of the present invention ensures that the resilient seal ring is maintained in contact with the piston by virtue of the fact that the taut, flexible band prevents the seal ring from being urged away from the piston, the band, in this regard, acting much like a rigid back-up to ensure constant, engaged sealing contact between the seal ring and the piston. At the same time, since the band can be flexed, the seal assembly can be distorted or collapsed sufficiently to allow it to be disposed in a peripheral groove such as groove 24, something that cannot be accomplished with a rigid or solid back-up ring.

The foregoing disclosure and description of the invention is illustrative and explanatory thereof, and various changes in size, shape and materials as well as in the details of the illustrated construction may be made within the scope of the appended claims without departing from the spirit of the invention.

What is claimed is:

1. A rotary actuator comprising:

a housing defining an arcuate chamber, said housing including a first monolithic portion and a second portion, said arcuate chamber being completely contained within said first portion, said first portion defining an aperture in open communication with said arcuate chamber, said second portion being adjacent to said first portion such that said second portion faces said aperture;

a piston disposed in said housing for reciprocable movement in said arcuate chamber;

a shaft journaled in said housing and connected to said piston, said shaft being rotated in response to movement of said piston;

a seal means disposed between said piston said housing for effecting sealing between said piston and said housing;

means to introduce fluid pressure into said housing to effect movement of said piston in a first direction; and means to effect movement of said piston in an opposite, second direction.

2. The actuator of claim 1 wherein said arcuate chamber is in the shape of a toroidal arc segment.

3. The actuator of claim 1 wherein said seal means is carried by said housing.

4. The actuator of claim 3 wherein said first portion of said housing includes a wall defining an inner wall surface, said inner wall surface at least partially defining said arcuate chamber, said wall defining an aperture into said arcuate chamber for receiving said piston, a peripherally extending grooive being formed in a portion of said wall in surrounding relationship to said aperture, and seal means being received in said groove in surrounding relationship to said piston.

5. The actuator of claim 4 wherein said piston has a symmetrical, cross-section configuration defined by opposed side surfaces and opposed arcuate end surfaces of said piston, said side surfaces being interconnected by said first and second arcuate end surfaces to form a generally elliptical cross-sectional configuration, the greatest distance between said side surface being less than the greatest distance between said end surfaces, said aperture formed by said wall in said housing having a generally elliptical cross-sectional configuration complementary to the cross-sectional configuration of said piston, said seal means including a resilient, a generally elliptical seal ring, said piston being received in and sealingly engaged by said seal ring, a generally elliptical, flexible band in surrounding, engaged relationship with said seal ring, said band having spaced, first and second side portions and spaced, first and second end portions adjoining said first and second side portions, the greatest distance between said portions being less than the greatest distance between said end portions, first and second rigid rib members being secured to said first and second side portions, respectively, of said band, said groove having peripherally extending, spaced first and second side walls, said seal means being received in said groove such that said resilient seal ring is in sealing engagement with said first and second side walls, said band serving to prevent outward bowing of said seal ring away from said portion, said groove having a depth sufficient to permit said seal means to float.

6. The actuator of claim 1 wherein said means to effect movement of said piston in an opposite, second direction comprises means to introduce fluid pressure into said second chamber.

7. The actuator of claim 1 wherein said second portion of said housing is monolithic, said seal means serves to isolate said arcuate chamber from a second chamber formed in said housing.

8. The actuator of claim 7 wherein said first and second portions of said housing are joined together such that a plane passing through adjoined surfaces of said first and second portions of said housing passes through said second chamber and parallel to the axis of rotation of said shaft.

9. A rotary actuator comprising:

a housing defining an arcuate chamber;

a piston disposed in said housing for reciprocable movement in said arcuate chamber;

a shaft journaled in said housing and connected to said piston, and shaft being rotated in response to movement of said piston;

seal means carried by one of said piston or said housing for effecting sealing between said piston and said housing, means to introduce fluid pressure into said arcuate chamber to effect movement of said piston in a first direction out of said arcuate chamber and rotation of said shaft in a first rotational direction; and means to effect movement of said piston in an opposite, second direction into said arcuate chamber and rotation of said shaft in a second rotational direction, said means to effect movement of said piston in second direction comprising:

a support positioned on said housing;

a compressible biasing member carried by said support;

a means interconnecting said biasing member and said shaft such that movement of said piston out of said arcuate chamber compresses said biasing member and being operative to provide a substantially constant torque acting upon said shaft as said biasing member moves from a compressed, first position to an uncompressed, second position whereby the torque acting on said shaft in said first and second rotational directions substantially constant.

10. The actuator of claim 9 wherein said arcuate chamber is in the shape of a torodial arc segment.

11. The actuator of claim 9 wherein said seal means is carried by said housing.

12. The actuator of claim 9 wherein said housing comprises a first portion, said first portion of said housing includes a wall defining an inner wall surface, said inner wall surface at least partially defining said arcuate chamber, said wall defining an aperture into said arcuate chamber for receiving said piston, a peripherally extending groove being formed in a portion of said wall in surrounding relationship to said aperture, said seal means being received in said groove in surrounding relationship to said piston.

13. The actuator of claim 12 wherein said piston has a symmetrical, cross-sectional confituration defined by opposed side surfaces and opposed arcuate end surfaces of said piston, said side surfaces being interconnected by said first and second arcuate end surfaces to form a generally elliptical cross-sectional configuration, the greatest distance between said side surfaces being less than the greatest distance between said end surfaces, said aperture formed by said wall in said housing having a generally elliptical cross-sectional configuration complementary to the cross-sectional configuration of said piston, said seal means including a resilient, generally elliptical seal ring, said piston being received in and sealingly engaged by said seal ring, a generally elliptical, flexible band in surrounding, engaged relationship with said seal ring, said band having spaced, first and second side portions and spaced first and second end portions adjoining said first and second side portions, the greatest distance between said side portions being less than the greatest distance between said end portions, first and second rigid rib members being secured to said first and second side portions, respectively, of said band, said groove having peripherally extending, spaced first and second side walls, said seal means being received in said groove such that said resilient seal ring is in sealing engagement with said first and second side walls, said band serving to prevent outward bowing of said seal ring away from said piston, said groove having a depth sufficient to permit said seal means to float.

14. The actuator of claim 9 wherein said housing defines a second chamber, said seal means serving to isolate said arcuate chamber from said second chamber, a hole being formed in said housing in open communication with said second chamber, a portion of said means interconnecting said biasing member and said shaft extending through said hole.

15. The actuator of claim 14 wherein said support comprises a canister, said canister having an end wall with an aperture therethrough, said aperture in said end wall and said hole in said housing being in register and wherein said compressible biasing member comprises a coil compression spring disposed in said canister.

16. The actuator of claim 15 wherein said means interconnecting said biasing member and said shaft includes a cam attached to said shaft, said cam forming a continuous cam surface, and a flexible member operatively connected to said cam whereby as said shaft rotates, said flexible member follows said cam surface.

17. The actuator of claim 16 wherein said flexible member extends through said aperture in said canister and said hole in said housing, the end of said flexible member distal said cam being attached to a spring guide, said spring guide being in operative engagement with one end of said spring whereby as said piston moves in said first direction out of said arcuate chamber, a spring plate urges said spring into compression.

18. The actuator of claim 17 wherein said piston and said shaft are connected by an arm, said cam being formed on said arm, said arm having a guide slot for slidably receiving said flexible member.

19. The actuator of claim 18 wherein said cam includes a pin, said flexible member being connected to said pin.

20. An apparatus for sealing between relatively movable members comprising:

a first member, said first member having a surface defining a bore, a peripheral groove being formed in said surface in surrounding relationship to said bore, said groove having peripherally extending, spaced first and second side walls;

a second member disposed in said bore and relatively movable with respect to said first member;

a seal assembly for effecting fluid tight sealing between said first and second members, said seal assembly including:

a resilient, generally elliptical seal ring, said second member being received in and sealingly engaged by said seal ring;

a generally flexible band in surrounding, engaged relationship with said seal ring;

said seal assembly being received in said groove such that said resilient seal ring is in sealing engagement with said first and second side walls in said groove, said band serving to prevent outward movement of said seal ring away from said second member, said groove having a depth sufficient to permit said seal assembly to float.

21. The apparatus of claim 20 wherein said first member comprises a housing for a rotary actuator.

22. The apparatus of claim 20 wherein said second member comprises a generally arcuate piston disposed for reciprocation in said housing, said piston being connected to a rotatable shaft journaled in said housing.

23. The apparatus of claim 20 wherein said second member has a symmetrical, cross-sectional configuration defined by opposide side surfaces and opposed, arcuate end surfaces, said side surfaces being interconnected by said first and second arcuate end surfaces to form a generally elliptical cross-sectional configuration, the greatest distance between said side surfaces being less than the greatest difference between said end surfaces, said bore having a generally elliptical cross-sectional configuration complementary to the cross-sectional configuration of said second member, said band is generally elliptical, said band having generally spaced first and second side portions and spaced first and second end portions adjoining said first and second side portions, the greatest distance between said side portions being less than the greatest distance between said end portions, first and second, rigid rib members being secured to said first and second side portions, respectively of said band.

* * * * *

UNITED STATES PATENT AND TRADEMARK OFFICE

CERTIFICATE OF CORRECTION

PATENT NO. : 5,007,330

DATED : April 16, 1991

INVENTOR(S) : Scobie et al

It is certified that error appears in the above-identified patent and that said Letters Patent is hereby corrected as shown below:

In column 8, Claim 4, line 37, change "grooive" to --groove--.

In column 8, Claim 5, line 42, change "cross-section" to --cross-sectional--.

In column 9, Claim 5, line 1, change "portion" to --piston--.

In column 12, line 5, Claim 23, change "opposide" to --opposed--.

Signed and Sealed this

Fifteenth Day of September, 1992

*Attest:*

DOUGLAS B. COMER

*Attesting Officer*

*Acting Commissioner of Patents and Trademarks*